United States Patent [19]

Ferguson

[11] Patent Number: 4,465,087

[45] Date of Patent: Aug. 14, 1984

[54] TENT

[75] Inventor: Robert W. Ferguson, Ann Arbor, Mich.

[73] Assignee: Oyster Tent Company, Ann Arbor, Mich.

[21] Appl. No.: 519,462

[22] Filed: Aug. 1, 1982

[51] Int. Cl.[3] ..... A45F 1/00

[52] U.S. Cl. ..... 135/101

[58] Field of Search ..... 135/87–89, 135/97, 101–106, 116, 117

[56] References Cited

U.S. PATENT DOCUMENTS

| | | | |
|---|---|---|---|
| 3,356,098 | 12/1967 | Krutzikowsky | 135/105 |
| 3,621,858 | 11/1971 | Steele | 135/87 |
| 3,741,224 | 6/1973 | Clelland | 135/87 |
| 4,271,856 | 6/1981 | Ferguson | 135/113 |
| 4,396,030 | 8/1983 | Ferguson | 135/88 |

FOREIGN PATENT DOCUMENTS

| | | | |
|---|---|---|---|
| 200740 | 5/1958 | Austria | 135/87 |
| 437958 | 11/1935 | United Kingdom | 135/87 |

*Primary Examiner*—James R. Feyrer

*Attorney, Agent, or Firm*—Stephenson and Boller

[57] ABSTRACT

A tent comprises improved interior space and construction by means of separate fabric pieces each forming respective portions of the top and sidewalls which join along an arch-shaped seam disposed centrally between the longitudinal ends of the tent. The longitudinal ends are of trapezoidal shape and comprise triangular shaped openings and associated flaps for selectively opening and closing the openings. Inverted U-shaped structures support the ends of the tent and include rods extending through sleeves at the ends of the top wall. Poles connect to the ends of the rods and are inclined so as to exert outward and upward forces on the ends of the tent to tension the top and sidewalls.

14 Claims, 3 Drawing Figures

TENT

BACKGROUND AND SUMMARY OF THE INVENTION

This invention relates generally to tents and it is specifically concerned with a new and improved tent construction which provides improved space within the tent's interior without complicated fabrication or erection procedures.

Reference is made to the inventor's U.S. Pat. No. 4,271,856 for a tent which in certain respects is similar to the improved tent of the present invention.

It is certainly desirable to have a tent which can be readily erected. Similarly, it is desirable to have a tent which does not comprise complicated construction. For example, minimizing cutting and seaming of fabric parts which are used to make a tent reduces the fabrication costs, and also reduces the risk of water leakage since the seams are in general more susceptible to water leakage than is the fabric body. It is also important to maximize the interior room space for occupant comfort and convenience while using a minimal amount of fabric material.

The present invention provides a tent which admirably complies with these desirable objectives. It is of a construction which can be readily erected, can be fabricated without an extensive amount of seaming, particularly at the sides and top, and which possesses improved interior space.

The foregoing features, advantages and benefits of the invention along with additional ones, will be seen in the ensuing description and claims which should be considered in conjunction with the accompanying drawings. The drawings disclose a preferred embodiment of the invention according to the best mode contemplated at the present time in carrying out the invention.

DESCRIPTION OF THE PREFERRED EMBODIMENT

Figure 1:
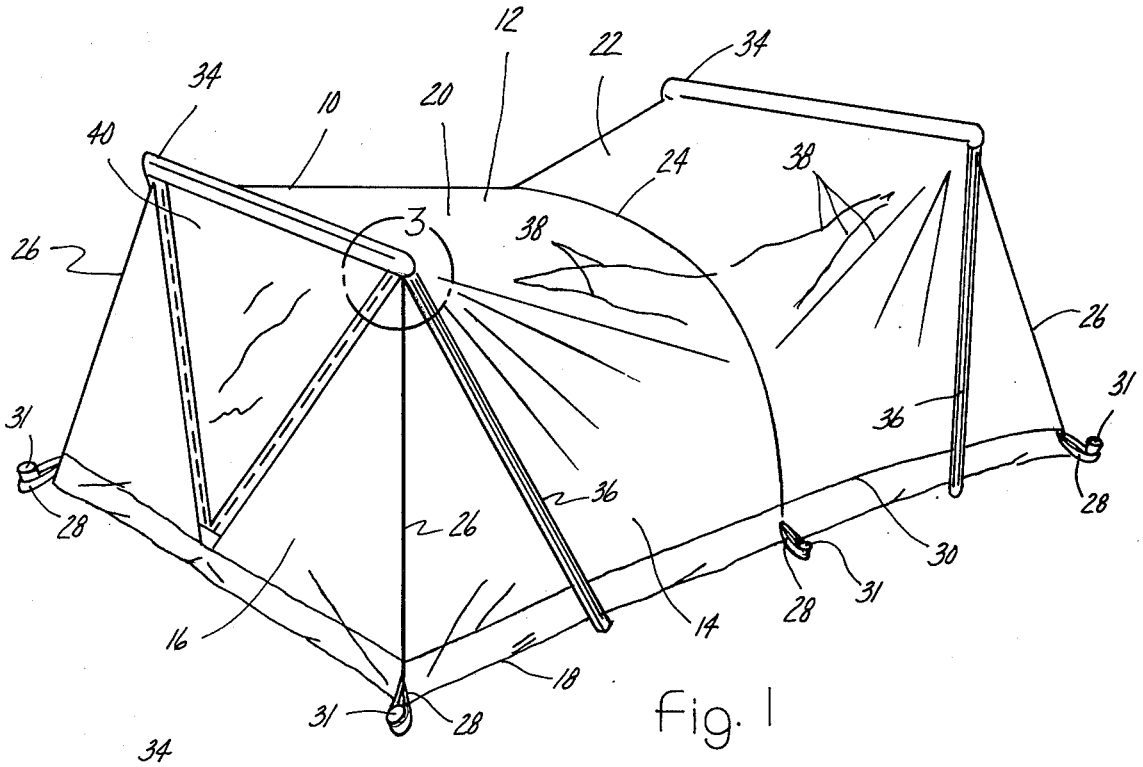
FIG. 1 is a perspective view illustrating an erected tent embodying principles of the present invention.

FIG. 1 illustrates an erected tent 10 embodying principles of the present invention. The tent of FIG. 1 is symmetrical and hence if viewed from the opposite perspective would appear essentially the same.

Tent 10 comprises a top wall 12, sidewalls 14, and end walls 16. It also includes an integral floor 18.

For purposes of explanation, the tent in its erected condition may be considered as of generally rectangular shape with there being four corners at the top wall and four corners at the base where the floor joins with the side and end walls.

The constructional features of the tent which contribute to its attributes described above comprise the top and sidewalls being fabricated from two pieces of tent fabric. These two pieces are identified by the reference numerals 20 and 22 respectively. Each piece joins with one of the end walls 16 and the two pieces 20 and 22 join together along a continuous seam 24. The seam 24 is generally of an arch shape extending up one sidewall, merging in a generally curved fashion into the top wall, extending across the top wall, merging downwardly into the opposite sidewall and extending down that opposite sidewall. The opposite edges of each of the fabric pieces forming the sections 20 and 22 join to the respective end walls 16 at the top and two side edges of the end walls along corresponding seams.

Each end wall 16 is of a generally trapezoidal shape. The top and bottom edges of the end wall correspond to the parallel sides of the trapezoid with the top edge being shorter. The side edges of the end walls are nonparallel and the seams 26 by which the side edges of the end walls join with the end edges of the sidewalls incline downwardly and outwardly from the top when the tent is in the erected condition.

Tent 10 is secured to a supporting surface, and the illustrated construction shows this to be the ground. The securement is provided by means of stake loops 28 which are attached to the base of the tent. There are six such stake loops, four at each of the four corners and two at the opposite ends of seam 24. The stake loops are secured to the perimeter 30 seam which joins the floor to the side and end walls. Stakes 31 hold the loops to the ground.

The tent is supported in the erected condition by means of inverted U-shaped structures disposed at the longitudinal ends of the tent. Each of the inverted U-shaped structures comprises a sturdy, horizontal support rod 32 which extends through a corresponding fabric sleeve 34 on the tent. Each sleeve 34 extends along the end edge of top wall 12 adjacent where it joins the top edge of the corresponding end wall 16. Poles 36 extend downwardly and inwardly from the ends of each rod 32 to engage the ground.

Sleeve 34 is constructed with openings which are disposed outboard of seams 26 and which face downwardly and inwardly. These openings allow poles 36 to extend from the ground upwardly and outwardly at an inclined angle to make connection with the ends of the rods within the sleeves.

Figure 3:
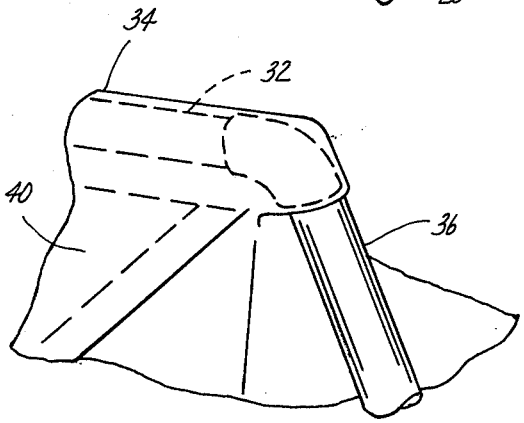
FIG. 3 is an enlarged view in circle 3 of FIG. 1.

FIG. 3 illustrates an exemplary construction in which the ends of rods 32 have elbows into which the upper ends of poles 36 are insertable. In the erected tent the poles are effective to exert upwardly and outwardly directed forces which are effective via the sleeves 34 at the upper end edges of the tent. Since the side edges of the end walls are seamed to the end edges of the sidewalls, the support forces are also effective to impart a certain tensioning not only to the top wall but the sidewalls as well. The tensioning action is applied in opposite directions to the tent to tension the top and sidewalls to a very substantial extent. However, due to the transition between the four sharp corners of the top wall and the curved arch-like nature of seam 24, the erected tent may have several creases such as those illustrated at 38 in FIG. 1. Advantageously the construction provides an improved interior space with the creases inclining downwardly toward seam 24. Any water which might fall upon the tent will be naturally directed to flow toward seam 24 and down the sides of the tent so as to avoid accumulation of standing water which might otherwise give rise to leakage into the tent.

Figure 2:
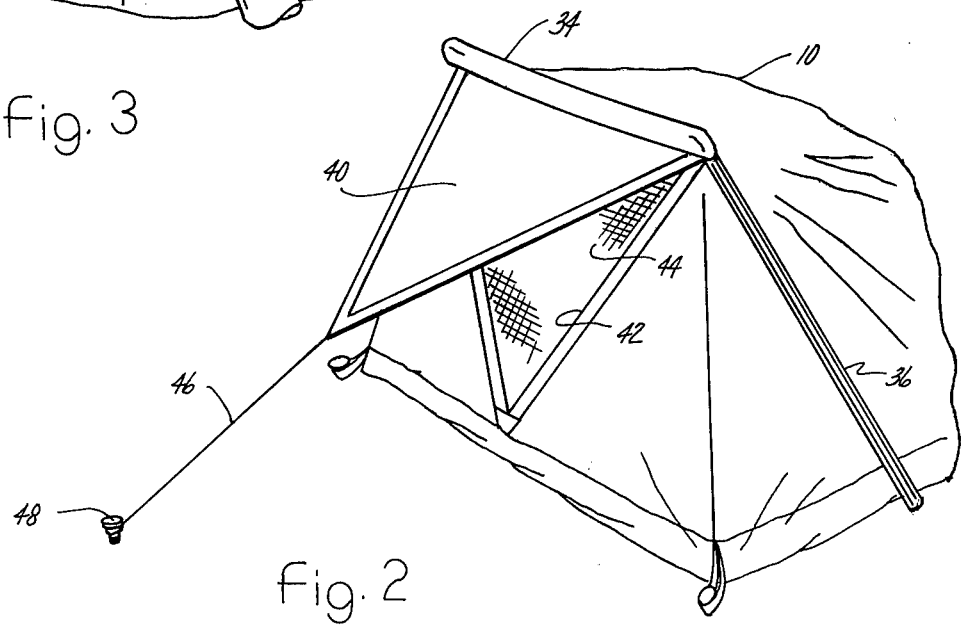
FIG. 2 is a fragmentary perspective view of a portion of the tent of FIG. 1 illustrating an alternate condition.

Tent 10 is also provided with triangular shaped flaps 40 at end walls 16. One edge of each triangular flap is secured to the tent along the corresponding sleeve 34. The apex opposite this edge therefore points downwardly. FIG. 1 illustrates the closed condition of a flap in which the flap overlies a corresponding triangular shaped opening 42 in the end wall which can be seen in FIG. 2. In FIG. 2 this triangular shaped opening is closed by a screen 44 of similar shape. Flaps 40 may be closed to provide privacy or alternatively may be operated to a condition such as shown in FIG. 2.

In FIG. 2 a rope or line 46 is attached to the free apex of the flap and the opposite end of the rope is secured to a stake 48 so that the flap 40 is drawn downwardly and outwardly to an inclined position away from the end wall such as illustrated. This provides for ingress and egress to and from the interior of the tent and it is also beneficial in that it complements the erection support which is provided by the U-shaped structures. In other words, it is effective to exert an additional outward force for support of the tent.

The tent may be readily erected for use and subsequently readily disassembled. The poles separably connect to the rods as explained above. The rods may be slid out of the sleeves through the openings at the ends of the sleeves by manipulation of the sleeve fabric over the elbows to provide clearances allowing the rods to be slid axially into and out of the sleeves. The tent may be folded into a compact condition for storage and transport.

The illustrated construction of the tent sections 20 and 22 provides an interior space which has improved head and shoulder room, yet which does not have any longitudinal seams in the top or sidewalls. By minimizing the amount of seaming, the risk of water leakage is reduced and also the fabrication costs associated with making the tent are kept low. The seaming of the several tent sections may be accomplished with conventional tent-making procedures and the fabrics which are utilized may be also selected from conventional tent fabrics. The poles and rods may be constructed of any suitable conventional materials such as plastic or aluminum rods.

The tent is also readily useable as a car-top tent since it has a rectangular floor and does not require external guy wires for support.

The tent can thus readily be mounted on a supporting platform or the like attached to a vehicle roof.

Although the illustrated construction shows the sleeves as joining with the top and end walls along what is essentially a common seam, it will be appreciated that alternate constructional details of the seams may be utilized.

The triangular shaped flaps are also advantageous since they allow the additional support as illustrated in FIG. 2 yet provide convenient ingress and egress to and from the interior of the tent while also providing a suitable privacy closure.

While a preferred embodiment of the invention has been disclosed, it will be appreciated that principles of the invention are applicable to other embodiments.

What is claimed is:

1. In a tent having a four cornered top wall and longitudinally extending sidewalls on opposite sides of said top wall, two tent fabric sections, each seamlessly forming respective portions of said top and sidewalls, said two fabric sections joining together along a continuous longitudinally central arch-shaped seam which extends transversely up one sidewall, merges into said top wall, extends across said top wall, merges into the opposite sidewall, and extends down said opposite sidewall, and means for supporting the tent in erected condition at the four corners of said top wall with the four corners of said top wall disposed vertically above the level of said seam as it extends across said top wall.

2. A tent as set forth in claim 1 further including end walls at the longitudinal ends of said top wall, each of said end walls having a trapezoidal shape comprising a pair of parallel edges and a pair of non-parallel edges, one of said parallel edges of each end wall extending across and joining with the corresponding end edge of said top wall, said non-parallel edges of said end walls joining with the corresponding edges of said sidewalls.

3. A tent as set forth in claim 2 in which said means for supporting the tent in erected condition at the four corners of said top wall includes transversely disposed sleeves each extending along the corresponding end edge of said top wall, a support rod disposed within each said sleeve, each said sleeve having openings at its ends, and poles passing through said openings engaging opposite ends of each said rod to support same.

4. A tent as set forth in claim 3 in which said openings open in a direction perpendicular to the length of each sleeve and are disposed outboard of the end edges of said top wall, said openings facing downwardly and inwardly, said poles extending through said openings downwardly and inwardly from said rods to support the tent in erected condition with an upwardly and outwardly force being applied to the end edges of said top wall.

5. A tent as set forth in claim 4 including flaps for said end walls, said flaps being of triangular shapes and having edges joining with said ones of said parallel edges of said end walls, said flaps having free apices opposite their joinders with said end walls, said end walls each having triangular openings corresponding to the triangular shapes of said flaps so as to be covered by said flaps when the flaps are disposed against the end walls.

6. A tent as set forth in claim 5 including lines extending from the free apices of said flaps, said lines and flaps being extended outwardly of the tent to points of support to assist in the support of the tent by said rods and poles.

7. A tent as set forth in claim 6 in which the tent has a four cornered base and including stake loops at the four corners of the base and at the ends of said seam.

8. A tent as set forth in claim 7 including an integral floor joining with the base.

9. A tent as set forth in claim 1 further including end walls at the longitudinal ends of said top wall, each of said end walls having a trapezoidal shape comprising a pair of parallel edges and a pair of nonparallel edges, one of said parallel edges of each end wall being shorter than the other of said parallel edges of the same end wall and extending across and joining with the corresponding end edge of said top wall, said non-parallel edges of said end walls joining with corresponding edges of said sidewalls.

10. A tent as set forth in claim 9 in which said end walls are of substantially identical shape and incline outwardly in the downward direction.

11. A tent as set forth in claim 1 in which said means for supporting the tent in erected condition at the four corners of said top wall includes transversely disposed sleeves each extending along the corresponding end edge of said top wall, a support rod disposed within each said sleeve, each said sleeve having openings at its ends, and poles passing through said openings engaging opposite ends of each said rod to support same.

12. A tent as set forth in claim 11 in which said sleeves are fully enclosed except for said openings which open in a direction perpendicular to the length of each sleeve and are disposed outboard of the end edges of said top wall, said openings facing downwardly and inwardly, said poles extending through said openings downwardly and inwardly from said rods to support the tent in erected condition with an upwardly and outwardly directed force being applied to the end edges of said top wall.

13. A tent as set forth in claim 1 further including end walls at the longitudinal ends of said top wall, each of said end walls having a top edge joining with the corresponding end edge of said top wall and side edges joining with the end edges of said sidewalls, at least one of said end walls having a triangularly shaped opening in which one side of the opening extends transversely across the end wall parallel to the corresponding end edge of said top wall and with the apex of the opening opposite said one edge thereof points downwardly.

14. A tent as set forth in claim 13 including a triangular flap for selectively opening and closing said opening.

* * * * *